US010995983B2

(12) United States Patent
Goloubev

(10) Patent No.: US 10,995,983 B2
(45) Date of Patent: May 4, 2021

(54) METHOD AND APPARATUS FOR OBTAINING A COMPRESSED GAS PRODUCT BY CRYOGENIC SEPARATION OF AIR

(71) Applicant: LINDE AKTIENGESELLSCHAFT, Munich (DE)

(72) Inventor: Dimitri Goloubev, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 652 days.

(21) Appl. No.: 14/788,909

(22) Filed: Jul. 1, 2015

(65) Prior Publication Data

US 2016/0187059 A1 Jun. 30, 2016

(30) Foreign Application Priority Data

Jul. 5, 2014 (EP) ..... 14002308

(51) Int. Cl.
*F25J 3/04* (2006.01)

(52) U.S. Cl.
CPC ..... *F25J 3/04412* (2013.01); *F25J 3/042* (2013.01); *F25J 3/0409* (2013.01); *F25J 3/04018* (2013.01); *F25J 3/04024* (2013.01); *F25J 3/04054* (2013.01); *F25J 3/04084* (2013.01); *F25J 3/04145* (2013.01); *F25J 3/04175* (2013.01); *F25J 3/04296* (2013.01); *F25J 3/04381* (2013.01); *F25J 3/04393* (2013.01); *F25J 3/04678* (2013.01);
(Continued)

(58) Field of Classification Search
CPC ..... F25J 3/04472–04515; F25J 3/04054; F25J 3/04412; F25J 3/04024; F25J 3/04145; F25J 3/04381
See application file for complete search history.

(56) References Cited

U.S. PATENT DOCUMENTS 5,123,249 A * 6/1992 Buttle ..... F25J 3/042 62/646
5,400,600 A 3/1995 Grenier
(Continued)

FOREIGN PATENT DOCUMENTS

DE 10 2010 052 545 A1 5/2012
EP 0 660 058 A2 6/1995
(Continued)

OTHER PUBLICATIONS

Translation of Tranier (Year: 2012).*

*Primary Examiner* — John F Pettitt, III
(74) *Attorney, Agent, or Firm* — Millen White Zelano & Branigan, PC; Brion P. Heaney

(57) ABSTRACT

A method and the apparatus for obtaining a compressed gas product by means of cryogenic separation of air in a distillation column system which has a high-pressure column and a low-pressure column. All of the feed air is compressed in a main air compressor to a first pressure which is at least 4 bar higher than the operating pressure of the high-pressure column. A first partial flow of the feed air compressed in the main air compressor is cooled to an intermediate temperature in a main heat exchanger and is expanded so as to perform work in a first air turbine. At least a first part of the first partial flow expanded so as to perform work is introduced into the distillation column system.

14 Claims, 3 Drawing Sheets

(52) U.S. Cl.
CPC ..... *F25J 3/04721* (2013.01); *F25J 3/04812* (2013.01); *F25J 2200/52* (2013.01); *F25J 2205/04* (2013.01); *F25J 2245/50* (2013.01)

(56) References Cited

U.S. PATENT DOCUMENTS

| | | | | |
|---|---|---|---|---|
| 5,475,980 | A | 12/1995 | Grenier et al. | |
| 6,463,758 | B1 | 10/2002 | Le Bot | |
| 9,360,250 | B2 * | 6/2016 | Ha | F25J 3/04 |
| 2011/0197630 | A1 * | 8/2011 | Guillard | F25J 3/0429 62/644 |
| 2012/0131952 | A1 * | 5/2012 | Alekseev | F25J 3/04024 62/643 |
| 2013/0219959 | A1 * | 8/2013 | Ha | F25J 3/04 62/643 |
| 2014/0007617 | A1 * | 1/2014 | Le Bot | F25J 3/04054 62/643 |

FOREIGN PATENT DOCUMENTS

| | | | | |
|---|---|---|---|---|
| EP | 2 634 517 | A1 | 9/2013 | |
| FR | 2 776 760 | A1 | 10/1999 | |
| FR | 2973485 | A1 * | 10/2012 | F25J 3/04054 |

* cited by examiner

METHOD AND APPARATUS FOR OBTAINING A COMPRESSED GAS PRODUCT BY CRYOGENIC SEPARATION OF AIR

CROSS REFERENCE TO RELATED APPLICATIONS

This application claims priority from European Patent Application EP 14002308.6 filed Jul. 5, 2014.

BACKGROUND OF THE INVENTION

The invention relates to a method and an apparatus for the variable obtaining of a compressed gas product by means of cryogenic separation of air.

Methods and apparatuses for the cryogenic separation of air are for example known from Hausen/Linde, Tieftemperaturtechnik [Cryogenics], 2nd Edition 1985, Chapter 4 (pages 281 to 337).

The distillation column system of such an installation can be designed as a two-column system (for example as a conventional Linde double column system), or also as a three- or multi-column system. In addition to the columns for nitrogen-oxygen-separation, it can have further apparatuses for obtaining high-purity products and/or other air components, in particular noble gases, for example argon production and/or krypton-xenon production.

The expression "condenser-evaporator" refers to a heat exchanger in which a first, condensing fluid flow enters into indirect heat exchange with a second, evaporating fluid flow. Each condenser-evaporator has a liquefaction space and an evaporation space, which consist of liquefaction passages and, respectively, evaporation passages. The condensation (liquefaction) of the first fluid flow takes place in the liquefaction space, the evaporation of the second fluid flow takes place in the evaporation space. The evaporation and liquefaction spaces are formed by groups of passages which are in a heat-exchanging inter-relationship. The evaporation space of a condenser-evaporator can be designed as a bath-type evaporator, a falling film evaporator or a forced flow evaporator.

In the process of the invention, a product flow pressurized in liquid form is evaporated against a heat transfer medium and is finally obtained as an internally compressed gas product. This method is also termed internal compression. It serves for obtaining a gaseous compressed product. In the case of a supercritical pressure, no phase change per se takes place; the product flow is then "pseudo-evaporated". The product flow can for example be an oxygen product from the low-pressure column of a two-column system or a nitrogen product from the high-pressure column of a two-column system, or respectively from the liquefaction space of a main condenser, via which the high-pressure column and the low-pressure column are in heat-exchanging connection.

Counter to the (pseudo-)evaporating product flow, a heat transfer medium at high pressure is liquefied (or, respectively, pseudo-liquefied if it is at a supercritical pressure). The heat transfer medium frequently consists of one part of the air, in the present case the "second partial flow" of the compressed feed air.

Internal compression methods are for example known from DE 830805, DE 901542 (=U.S. Pat. No. 2,712,738/U.S. Pat. No. 2,784,572), DE 952908, DE 1103363 (=U.S. Pat. No. 3,083,544), DE 1112997 (=U.S. Pat. No. 3,214,925), DE 1124529, DE 1117616 (=U.S. Pat. No. 3,280,574), DE 1226616 (=U.S. Pat. No. 3,216,206). DE 1229561 (=U.S. Pat. No. 3,222,878), DE 1199293, DE 1187248 (=U.S. Pat. No. 3,371,496), DE 1235347, DE 1258882 (=U.S. Pat. No. 3,426,543), DE 1263037 (=U.S. Pat. No. 3,401,531), DE 1501722 (=U.S. Pat. No. 3,416,323), DE 1501723 (=U.S. Pat. No. 3,500,651), DE 253132 (=U.S. Pat. No. 4,279,631), DE 2646690, EP 93448 B1 (=U.S. Pat. No. 4,555,256), EP 384483 B1 (=U.S. Pat. No. 5,036,672), EP 505812 B1 (=U.S. Pat. No. 5,263,328), EP 716280 B1 (=U.S. Pat. No. 5,644,934), EP 842385 B1 (=U.S. Pat. No. 5,953,937), EP 758733 B1 (=U.S. Pat. No. 5,845,517), EP 895045 B1 (=U.S. Pat. No. 6,038,885), DE 19803437 A1, EP 949471 B1 (=U.S. Pat. No. 6,185,960 B1), EP 955509 A1 (=U.S. Pat. No. 6,196,022 B1), EP 1031804 A1 (=U.S. Pat. No. 6,314,755), DE 19909744 A1, EP 1067345 A1 (=U.S. Pat. No. 6,336,345), EP 1074805 A1 (=U.S. Pat. No. 6,332,337), DE 19954593 A1, EP 1134525 A1 (=U.S. Pat. No. 6,477,860), DE 10013073 A1, EP 1139046 A1, EP 1146301 A1, EP 1150082 A1, EP 1213552 A1, DE 10115258 A1, EP 1284404 A1 (=US 2003051504 A1), EP 1308680 A1 (=U.S. Pat. No. 6,612,129 B2), DE 10213212 A1, DE 10213211 A1, EP 1357342 A1 or DE 10238282 A1, DE 10302389 A1, DE 10334559 A1, DE 10334560 A1, DE 10332863 A1, EP 1544559 A1, EP 1585926 A1, DE 102005029274 A1, EP 1666824 A1, EP 1672301 A1, DE 102005028012 A1, WO 2007033838 A1, WO 2007104449 A1, EP 1845324 A1, DE 102006032731 A1, EP 1892490 A1, DE 102007014643 A1, EP 2015012 A2, EP 2015013 A2, EP 2026024 A1, WO 2009095188 A2 or DE 102008016355 A1.

The invention relates in particular to systems in which all of the feed air is compressed to a pressure which is much higher than the highest distillation pressure which prevails within the columns of the distillation column system (this is normally the high-pressure column pressure). Such systems are also termed HAP (high air pressure) processes. In that context, the "first pressure", that is to say the outlet pressure of the main air compressor (MAC), in which all of the air is compressed, is for example more than 4 bar, in particular 6 to 16 bar above the highest distillation pressure. In absolute terms, the "first pressure" is for example between 17 and 25 bar. In HAP-methods, the main air compressor is normally the only machine for compressing air which is driven by external energy. An "only machine" is understood here as a single-stage or multi-stage compressor whose stages are all connected to the same drive, wherein all stages are contained in the same casing or are connected to the same drive.

One alternative to such HAP methods are what are termed MAC-BAC methods, in which the air in the main air compressor is compressed to a relatively low total air pressure, for example to the operating pressure of the high-pressure column (plus pipe losses). One part of the air from the main air compressor is compressed to a higher pressure in an air post-compressor (or BAC—booster air compressor) driven by external energy. This air part at high pressure (often called throttle flow) provides the majority of the heat required in the main heat exchanger for the (pseudo-)evaporation of the internally compressed product. It is expanded downstream of the main air compressor in a throttle valve or in a liquid turbine (or DLE—dense liquid expander) to the pressure required in the distillation column system.

A method of the type mentioned in the introduction, with a first post-compressor (hot booster) and a second post-compressor (cold booster) connected in series is known from DE 102010055448 A1.

The invention is based on the object of further improving such a method with respect to energy efficiency.

SUMMARY OF THE INVENTION

This object is achieved by a method for obtaining a compressed gas product (72; 73) by means of cryogenic separation of air in a distillation column system which has a high-pressure column (21) and a low-pressure column (22), in which

- all of the feed air is compressed in a main air compressor (2) to a first pressure which is at least 4 bar higher than the operating pressure of the high-pressure column (21),
- a first partial flow (8, 11, 14) of the feed air (7) compressed in the main air compressor (2) is cooled to an intermediate temperature in a main heat exchanger (13) and is expanded so as to perform work in a first air turbine (15),
- at least a first part of the first partial flow (16) expanded so as to perform work is introduced (40; 18, 19, 20) into the distillation column system,
- a second partial flow (12, 27, 29, 30) of the feed air compressed in the main air compressor (2) is post-compressed in a first post-compressor (9), which in particular is driven by the first turbine (15), to a second pressure which is higher than the first pressure, is cooled in the main heat exchanger (13) to an intermediate temperature, is post-compressed in a second post-compressor (28), which is operated as a cold compressor and in particular is driven by the second turbine (38), to a third pressure which is higher than the second pressure, is cooled in the main heat exchanger (13) and then expanded (31) and introduced (32) into the distillation column system,
- a third partial flow (436, 37) of the feed air (7) compressed in the main air compressor (2) is cooled in the main heat exchanger (13) to an intermediate temperature and is expanded so as to perform work in a second air turbine (38) and
- at least a first part (339) of the third partial flow expanded so as to perform work is introduced (340) into the distillation column system,
- a first product flow (69; 75) is removed in liquid form from the distillation column system and is subjected to a pressure increase (71; 76) to a first product pressure,
- the first product flow at the first product pressure is evaporated or pseudo-evaporated and heated in the main heat exchanger (13) and
- the heated first product flow (72; 77) is obtained as first compressed gas product (GOX IC; GAN IC), characterized in that

- the third partial flow (37) is expanded in the second air turbine (38) to a pressure which is at least 1 bar higher than the operating pressure of the high-pressure column (21),
- the inlet pressure of the first air turbine (15) is at least 1 bar smaller than the third pressure and
- at least a first part (339) of the third partial flow expanded so as to perform work is further cooled and liquefied in the main heat exchanger (13) and then expanded (341) and is introduced into the distillation column system.

In addition to the "second partial flow"—the throttle flow at the particularly high third pressure—a further throttle flow at a relatively low pressure of for example 7 to 15 bar, in particular 10 to 13 bar, is fed through the cold part of the main heat exchanger. This further throttle flow is formed by the "third partial flow" of the air downstream of its expansion in the second air turbine. The additional air flow in the cold part of the main heat exchanger makes it possible to achieve an expedient heat exchange diagram and thus to save energy, in particular if nitrogen between 7 and 15 bar is obtained as internally compressed product.

In many cases, it is possible to further optimize the heat-exchange process in the main heat exchanger in that a fourth partial flow of the air compressed in the main air compressor at the first pressure, the outlet pressure of the main air compressor, is cooled in the main heat exchanger and then expanded and is introduced into the distillation column system.

One or both of the two turbine flows, together with the second partial flow, can be post-compressed to the second pressure in the first post-compressor, in that the first partial flow together with the second partial flow is raised in the first post-compressor (9) to the second pressure and is introduced into the first air turbine (15) at the second pressure. Further the third partial flow together with the second partial flow and where appropriate with the first partial flow is raised in the first post-compressor (9) to the second pressure and is introduced into the second air turbine (38) at the second pressure.

In particular, the third partial flow can also remain without post-compression; it is then introduced into the second air turbine at the first pressure.

If the system is to be occasionally operated with particularly low liquid production or as a pure gas installation, it is expedient at these times for a second part of the third partial flow expanded so as to perform work to be introduced not into the main heat exchanger but into the liquefaction space of a sump evaporator of the high-pressure column which is formed as a condenser-evaporator.

The flow at least partially condensed in the evaporation space of the sump evaporator of the high-pressure column is then preferably fed to an intermediate location of the high-pressure column.

BRIEF DESCRIPTION OF THE DRAWINGS

The invention, and further details of the invention, is explained in more detail below with reference to exemplary embodiments of the inventive air separation plant represented schematically in FIGS. 1, 2 and 3.

DETAILED DESCRIPTION OF THE INVENTION

Figure 1:
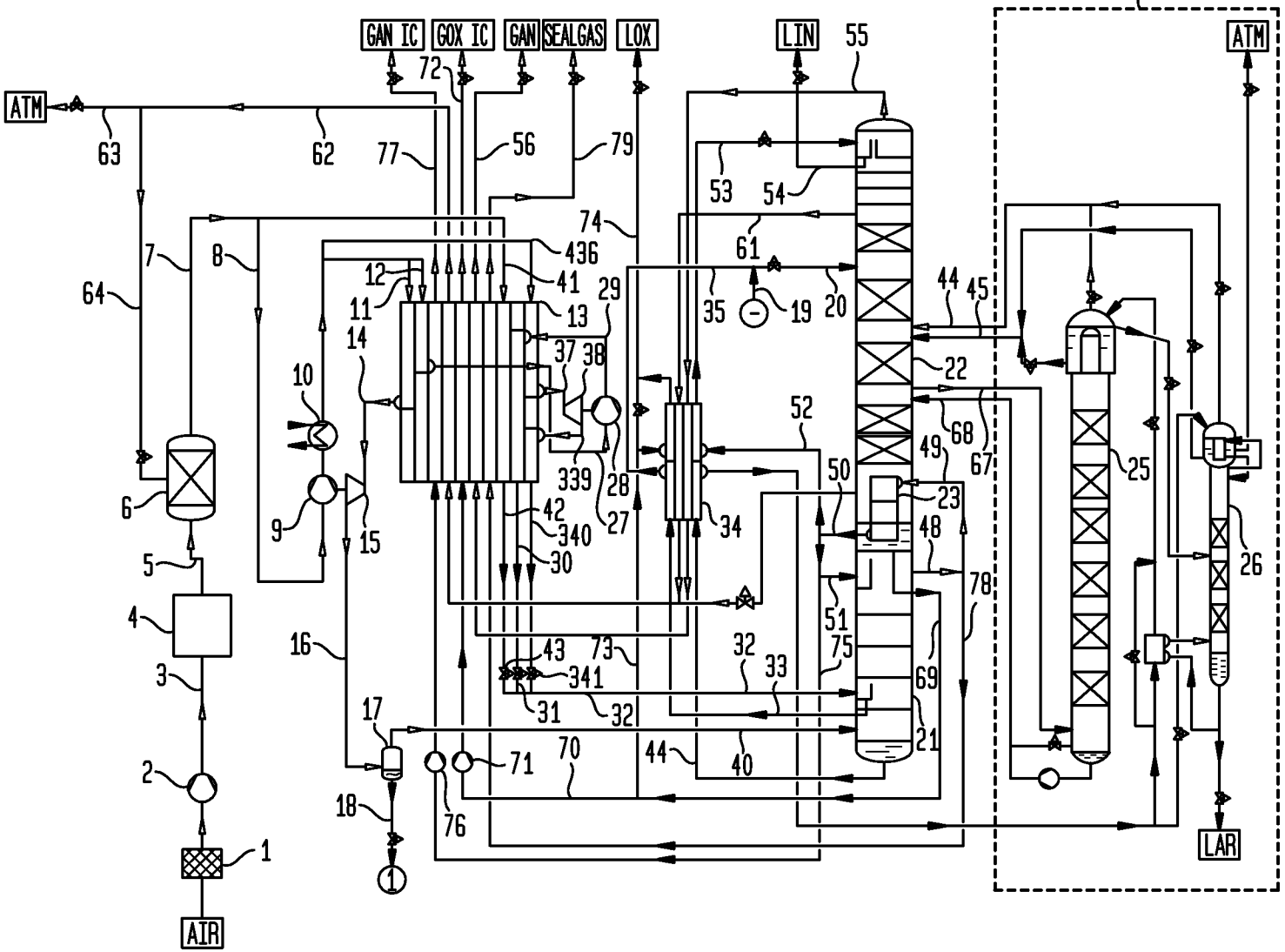

In FIG. 1, atmospheric air (AIR) is drawn in, via a filter 1, by a main air compressor 2. The main air compressor has, in the example, five stages and compresses the entire air flow to a "first pressure" of for example 19.7 bar. The entire air flow 3 downstream of the main air compressor 2 is cooled at the first pressure in a pre-cooler 4. The pre-cooled entire air flow 5 is purified in a purification unit 6 which in particular consists of a pair of switchable molecular sieve-adsorbers. A first part 8 of the purified entire air flow 7 is post-compressed, in a hot-operated air post-compressor 9 with a post-cooler 10, to a "second pressure" of for example 24 bar and is then split into a "first partial flow" 11 (first turbine air flow) and a "second partial flow" 12 (first throttle flow).

The first partial flow 11 is cooled in a main heat exchanger 13 to a first intermediate temperature of approx. 135 K. The cooled first partial flow 14 is expanded so as to perform work in a first air turbine 15, from the second pressure to approximately 5.5 bar. The first air turbine 15 drives the hot air post-compressor 9. The first partial flow 16 expanded so as to perform work is introduced into a separator (phase separator) 17. The liquid fraction 18 is introduced, via the lines 19 and 20, into the low-pressure column 22 of the distillation column system.

The distillation column system comprises a high-pressure column 21, the low-pressure column 22 and a main condenser 23 as well as common argon production 24 with a crude argon column 25 and a pure argon column 26. The main condenser 23 is designed as a condenser-evaporator, in the concrete example as a cascade evaporator. The operating pressure at the top of the high-pressure column is in this example 5.3 bar; that at the top of the low-pressure column is 1.35 bar.

The second partial flow 12 of the feed air is cooled in the main heat exchanger 13 to a second intermediate temperature which is higher than the first intermediate temperature, is fed via line 27 to a cold compressor 28 where it is post-compressed to a "third pressure" of approx. 35 bar. The post-compressed second partial flow 29 is reintroduced, at a third intermediate temperature which is higher than the second intermediate temperature, into the main heat exchanger 13 where it is cooled to the cold end. The cold second partial flow 30 is expanded in a throttle valve 31 to close to the operating pressure of the high-pressure column and is fed via line 32 to the high-pressure column 21. One part 33 is removed again, is cooled in a counter-current subcooler 34 and is injected via lines 35 and 20 into the low-pressure column 22.

A "third partial flow" 436 of the feed air is introduced at the second pressure into the main heat exchanger 13 where it is cooled to a fourth intermediate temperature, which in the example is somewhat higher than the first intermediate temperature. The cooled first partial flow 37 is expanded so as to perform work in a second air turbine 38, from the first pressure. The turbine flow 339 expanded so as to perform work is at a pressure which is at least 1 bar, in particular 4 to 10 bar, above the operating pressure of the high-pressure column, and a temperature which is at least 10 K, in particular 15 to 40 K, above the inlet temperature of the low-pressure nitrogen flows 55, 61 at the cold end of the main heat exchanger. This flow is then cooled further in the cold part of the main heat exchanger. The further cooled third partial flow 340 is expanded as third throttle flow in a throttle valve 341 to near high-pressure column pressure and is introduced via line 32 into the high-pressure column. This permits further optimization of the heat-exchange process in the main heat exchanger, in particular in the case of relatively low GAN-IC pressures of for example 7 to 15 bar, in particular approximately 12 bar.

The second air turbine 38 drives the cold compressor 28. The gas fraction from separator 17 is fed via line 40 to the sump of the high-pressure column 21.

(The division into the partial flows at identical pressure could also, in contrast to the representation in the drawing of FIG. 1, be carried out within the main heat exchanger 13.)

A "fourth partial flow" 41 (second throttle flow) flows through the main heat exchanger 13 from the hot to the cold end, at the first pressure. The cold fourth partial flow 42 is expanded in a throttle valve 43 to close to the operating pressure of the high-pressure column and is fed via line 32 to the high-pressure column 21.

The oxygen-enriched sump liquid 44 of the high-pressure column 21 is cooled in the counter-current subcooler 34 and is introduced into the optional argon production 24. Gas 44 and residual liquid 45 produced thereby are injected into the low-pressure column 22.

A first part 49 of the top nitrogen 48 of the high-pressure column 21 is entirely or essentially entirely liquefied in the liquefaction space of the main condenser 23 counter to liquid oxygen from the sump of the low-pressure column evaporating in the evaporation space. A first part 51 of the liquid nitrogen 50 generated in this manner is given up as return flow to the high-pressure column 21. A second part 52 is cooled in the counter-current subcooler 34 and is fed via line 53 into the low-pressure column 22. At least one part of the liquid low-pressure nitrogen 53 serves as return flow in the low-pressure column 21; another part 54 can be obtained as liquid nitrogen product (LIN).

Gaseous crude nitrogen 61 is drawn off from an intermediate location in the low-pressure column 22 and is heated in the counter-current subcooler 34 and in the main heat exchanger 13. The hot crude nitrogen 62 can be vented (63) into the atmosphere (ATM) and/or can be used as regeneration gas 64 for the purification device 6. Gaseous nitrogen 55 from the top of the low-pressure column 22 is also heated in the counter-current subcooler 34 and in the main heat exchanger 13 and is drawn off via line 56 as low-pressure nitrogen product (GAN).

The lines 67 and 68 (so-called argon transition) connect the low-pressure column 21 to the crude argon column 25 of the argon production 24.

A first part 70 of the liquid oxygen 69 from the sump of the low-pressure column 21 is drawn off as "first product flow", is raised in an oxygen pump 71 to a "first product pressure" of for example 37 bar, is evaporated at the first product pressure in the main heat exchanger 13 and finally is obtained via line 72 as "first compressed gas product" (GOX IC—internally compressed gaseous oxygen).

A second part 73 of the liquid oxygen 69 from the sump of the low-pressure column 21 is, where appropriate, cooled in the counter-current subcooler 34 and obtained via line 74 as liquid oxygen product (LOX).

In the example, also a third part 75 of the liquid nitrogen 50 from the high-pressure column 21 or from the main condenser 23 undergoes internal compression, in that it is raised in a nitrogen pump 76 to a second product pressure of for example 12 bar, is pseudo-evaporated at the second product pressure in the main heat exchanger 13 and finally is obtained via line 77 as internally compressed gaseous nitrogen product (GAN IC).

A second part 78 of the gaseous top nitrogen 48 of the high-pressure column 21 is heated in the main heat exchanger and obtained via line 79 either as gaseous intermediate-compressed product or—as shown—used as seal gas for one or more of the process pumps shown.

Figure 2:
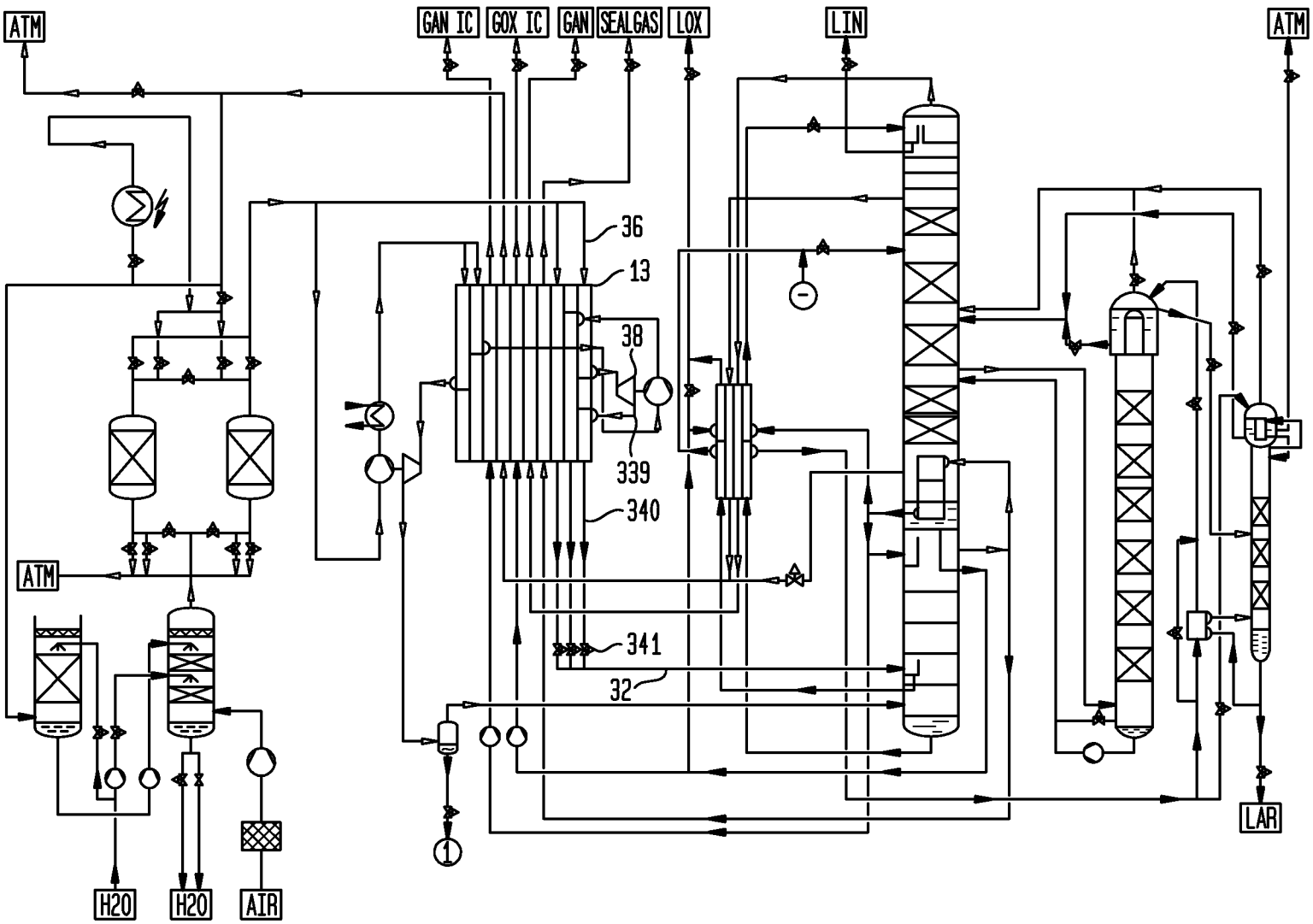

FIG. 2 differs from FIG. 1 in that the third partial flow 36 of the feed air is introduced at the first pressure into the main heat exchanger 13 and the second turbine 38 thus has an accordingly lower inlet pressure.

Figure 3:
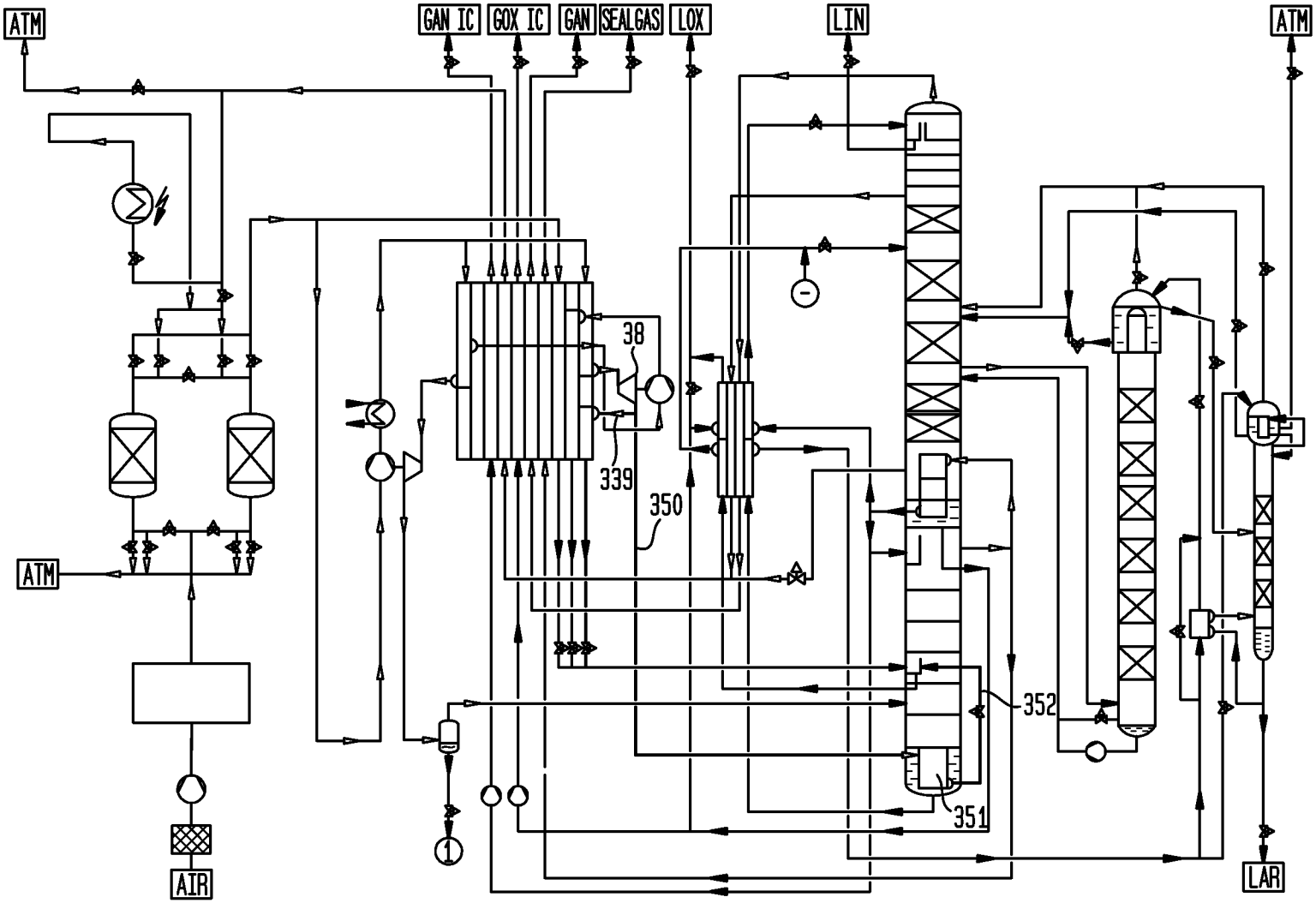

In the exemplary embodiment of FIG. 3, the high-pressure column has a sump evaporator 351. This sump evaporator is then used in particular if, at least occasionally, a particularly low liquid production or even pure gas operation is desired. The turbine 38 of the preceding exemplary embodiments cannot be run with its maximum throughput as, in that case, too much air as third partial flow would have to be run through the cold end of the main heat exchanger and the operation of the main heat exchanger would thus be less efficient.

In FIG. 3, it is now possible in the case of particularly low liquid production for one part 350 of the third partial flow from the turbine 38 to be guided past the main heat exchanger. The turbine 38 (and thus the coupled cold compressor) can now be run with full throughput without burdening the heat-exchange process in the main heat exchanger. The flow 350 is at least partially condensed in the evaporation space of the sump evaporator 351 and is then fed via line 352 to an intermediate location of the high-pressure column. It thus reinforces the distillation in the lower part of the high-pressure column.

Notwithstanding the representation in FIG. 3, the flow 350 can also be cooled in the main heat exchanger to the dew state prior to introduction into the sump evaporator. This can take place in a separate passage, but also by means of an intermediate takeoff at a suitable location and corresponding rerouting.

What I claim is:

1. A method for obtaining a compressed gas product by means of cryogenic separation of air in a distillation column system which has a high-pressure column, a low-pressure column, and a main condenser, said method comprising:

compressing all of a feed air in a main air compressor to a first pressure which is at least 4 bar higher than an operating pressure of the high-pressure column, cooling a first partial flow of the feed air compressed in the main air compressor to a first intermediate temperature in a main heat exchanger to produce a cooled first partial flow, and expanding the cooled first partial flow to perform work in a first air turbine to produce an expanded first partial flow, introducing at least a first part of the expanded first partial flow into the distillation column system, compressing a second partial flow of the feed air compressed in the main air compressor in a first booster compressor, which is driven by the first air turbine, to a second pressure which is higher than the first pressure, cooling the second partial flow in the main heat exchanger to a second intermediate temperature to form a cooled second partial flow, compressing the cooled second partial flow in a second booster compressor, which is driven by a second air turbine, to a third pressure which is higher than the second pressure, to produce a further compressed second partial flow, cooling said further compressed second partial flow in the main heat exchanger and then expanding said further compressed second partial flow to produce an expanded second partial flow, and introducing said expanded second partial flow into the distillation column system, cooling a third partial flow of the feed air compressed in the main air compressor in the main heat exchanger to a third intermediate temperature to produce a cooled third partial flow, expanding said cooled third partial flow to perform work in the second air turbine to produce an expanded third partial flow, and introducing at least a first part of the expanded third partial flow into the distillation column system, removing a first product flow in liquid form from the distillation column system and pressurizing the first product flow to a first product pressure, evaporating or pseudo-evaporating the first product flow at the first product pressure in the main heat exchanger and heating evaporated or pseudo-evaporated first product flow in the main heat exchanger to form said compressed gas product, and removing a second product flow from the high-pressure column or from the main condenser, pressurizing the second product flow to a second product pressure, heating the second product flow in the main heat exchanger at the second product pressure to form a further compressed gas product, wherein:

wherein the main condenser provides heat exchange between gas from an upper region of the high-pressure column and liquid from a bottom region of the low-pressure column, the cooled third partial flow is expanded in the second air turbine to a pressure which is at least 1 bar higher than the operating pressure of the high-pressure column, an inlet pressure of the first air turbine is at least 1 bar lower than the third pressure, and before being introduced into the distillation column system, said at least a first part of the expanded third partial flow is cooled and liquefied in the main heat exchanger and then expanded.

2. The method according to claim 1, further comprising cooling a fourth partial flow of the air compressed in the main air compressor in the main heat exchanger at the first pressure to produce a cooled fourth partial flow, expanding said cooled fourth partial flow, and introducing expanded fourth partial flow into the distillation column system.

3. The method according to claim 1, wherein the third partial flow, together with the second partial flow, is compressed in the first booster compressor to the second pressure before the third partial flow is introduced into the second air turbine at the second pressure.

4. The method according to claim 1, wherein the third partial flow is introduced into the second air turbine at the first pressure.

5. The method according to claim 1, wherein a second part of the expanded third partial flow is not introduced into the main heat exchanger, and wherein said second part of the expanded third partial flow is introduced into a liquefaction space of a sump evaporator of the high-pressure column which is a condenser-evaporator and at last partially condensed therein.

6. The method according to claim 5, wherein the second part of the expanded third partial flow that is at least partially condensed in the sump evaporator is introduced into the high-pressure column at an intermediate point thereof.

7. An apparatus for obtaining a compressed gas product by means of cryogenic separation of air comprising:

a distillation column system which has a high-pressure column, a low-pressure column, and a main condenser wherein the main condenser provides heat exchange between gas from an upper region of the high-pressure column and liquid from a bottom region of the low-pressure column, a main air compressor for compressing all of a feed air to a first pressure which is at least 4 bar higher than an operating pressure of the high-pressure column, a line for introducing a first partial flow of the feed air compressed in the main air compressor into a main heat exchanger, a line for removing the first partial flow, cooled to a first intermediate temperature, from the main heat exchanger, a line for introducing the first partial flow cooled to the first intermediate temperature into a first air turbine where the first partial flow is expanded to perform work, a line for introducing the first partial flow from the first air turbine into the distillation column system, a first booster compressor, driven by the first air turbine, for further compressing a second partial flow of the feed air compressed in the main air compressor to a second pressure, which is higher than the first pressure, to produce a further compressed second partial flow, a line for introducing the further compressed second partial flow into the main heat exchanger, and a line for removing the further compressed second partial flow from the main heat exchanger at a second intermediate temperature, a second booster compressor, driven by a second air turbine, for compressing the second partial flow, removed from the main heat exchanger at the second intermediate temperature, to a third pressure which is higher than the second pressure, and wherein the first partial flow of the feed air is introduced into the first air turbine at an inlet pressure which is at least 1 bar lower than the third pressure, a line for introducing the second partial flow at the third pressure into the main heat exchanger, a line for removing the second partial flow at the third pressure from the main heat exchanger, means for expanding the second partial flow removed from the main heat exchanger to produce an expanded second partial flow, and a line for introducing the expanded second partial flow into the distillation column system, a line for introducing a third partial flow of the feed air compressed in the main air compressor into the main heat exchanger, and a line for removing the third partial flow from the main heat exchanger at a third intermediate temperature, a second air turbine for work-performing expansion of the third partial flow removed from the main heat exchanger at the third intermediate temperature to produce an expanded third partial flow at a pressure which is at least 1 bar higher than the operating pressure of the high-pressure column, a line for introducing the expanded third partial flow into the main heat exchanger wherein the expanded third partial flow is cooled and liquified, means for expanding the liquefied third partial flow, and a line for introducing the expanded liquefied third partial flow into the distillation column system, a line for removing in liquid form a first product flow from the distillation column system, a pump for pressurizing the first product flow removed from the distillation column system to a first product pressure, a line for introducing the first product flow at the first product pressure into the main heat exchanger wherein the first product flow is evaporated or pseudo-evaporated to form said compressed gas product, a line for removing the compressed gas product from the main heat exchanger, a line for removing in liquid form a second product flow from the high-pressure column or from the main condenser, a further pump for pressurizing the second product flow removed from the distillation column system the high-pressure column or from the main condenser to a second product pressure, a line for introducing the second product flow at the second product pressure into the main heat exchanger wherein the second product flow is heated to form a further compressed gas product, and a line for removing the further compressed gas product from the main heat exchanger.

8. The method according to claim 1, wherein the third partial flow, together with the second partial flow and the first partial flow, is compressed in the first booster compressor to the second pressure before the third partial flow is introduced into the second air turbine at the second pressure.

9. The method according to claim 1, wherein the second intermediate temperature which is higher than the first intermediate temperature.

10. The method according to claim 1, wherein said further compressed second partial flow is introduced into the main heat exchanger at a further intermediate temperature which is higher than the second intermediate temperature.

11. The method according to claim 1, wherein the third intermediate temperature which is higher than the first intermediate temperature.

12. A method for obtaining a compressed gas product by means of cryogenic separation of air in a plant having a main heat exchanger and a distillation column system having a high-pressure column and a low-pressure column, said method comprising:

compressing all of a feed air in a main air compressor to form compressed feed air at a first pressure which is at least 4 bar higher than an operating pressure of the high-pressure column, compressing a first partial steam of the compressed feed air in a first booster compressor to a second pressure and introducing the first partial stream of the compressed feed air into the main heat exchanger at the second pressure, which is higher than the first pressure, removing a first part of the first partial flow of the compressed feed air from the main heat exchanger at a first intermediate temperature, and expanding the first part of the first partial flow to perform work in a first air turbine to produce an expanded first part of the first partial flow, wherein the first air turbine drives the first booster compressor introducing at least a portion of the expanded first part of the of the first partial flow into the distillation column system, removing a second part of the first partial flow of the compressed feed air from the main heat exchanger at a second intermediate temperature, compressing the second part of the first partial flow in a second booster compressor, which is driven by a second air turbine, to a third pressure which is higher than the second pressure, to produce a further compressed second part of the first partial flow, cooling said further compressed second part of the first partial flow in the main heat exchanger and then expanding said further compressed second partial flow to produce an expanded second partial flow, and introducing said expanded second partial flow into the distillation column system, cooling a further partial flow of the feed air compressed in the main air compressor in the main heat exchanger to a third intermediate temperature to produce a cooled further partial flow, expanding said cooled further partial flow to perform work in the second air turbine to produce an expanded further partial flow, and introducing at least a first part of the expanded further partial flow into the distillation column system, removing a first product flow in liquid form from the distillation column system and pressurizing the first product flow to a first product pressure, and evaporating or pseudo-evaporating the first product flow at the first product pressure in the main heat exchanger and heating evaporated or pseudo-evaporated first product flow in the main heat exchanger to form said compressed gas product, wherein:

the cooled further partial flow is expanded in the second air turbine to a pressure which is at least 1 bar higher than the operating pressure of the high-pressure column, an inlet pressure of the first air turbine is at least 1 bar lower than the third pressure, and before being introduced into the distillation column system, said at least a first part of the expanded further partial flow is cooled and liquefied in the main heat exchanger and then expanded.

13. The method according to claim 12, wherein the further partial flow of the feed air compressed in the main air compressor is introduced into the main heat exchanger at the second pressure.

14. The method according to claim 12, wherein the further partial flow of the feed air compressed in the main air compressor is introduced into the main heat exchanger at the first pressure.

* * * * *